United States Patent [19]

Mizunuma

[11] Patent Number: 4,863,164

[45] Date of Patent: Sep. 5, 1989

[54] STRING PICKUP GAME

[75] Inventor: Masanori Mizunuma, Tokyo, Japan

[73] Assignee: Tomy Kogyo Co., Inc., Tokyo, Japan

[21] Appl. No.: 307,462

[22] Filed: Feb. 8, 1989

[30] Foreign Application Priority Data

Jun. 10, 1988 [JP] Japan ..... 63-77015

[51] Int. Cl.[4] ..... A63F 9/00

[52] U.S. Cl. ..... 273/1 GG; 446/338; 446/339

[58] Field of Search ..... 273/1 GG, 1 G; 446/337, 446/339, 338, 352, 359, 365, 366, 368, 390

[56] References Cited

U.S. PATENT DOCUMENTS

| | | | |
|---|---|---|---|
| 2,996,836 | 8/1961 | Tieri | 446/339 X |
| 3,578,319 | 5/1971 | Kohner et al. | 273/1 GG |
| 3,960,377 | 6/1976 | Doyle | 273/1 GG |
| 4,315,650 | 2/1982 | Yoshida | 446/390 |
| 4,412,682 | 11/1983 | Rehkemper | 273/1 GG |
| 4,469,327 | 9/1984 | Ulrich et al. | 273/1 GG |

*Primary Examiner*—Paul E. Shapiro

*Attorney, Agent, or Firm*—Staas & Halsey

[57] ABSTRACT

A string pickup game apparatus includes a pair of supporters each of which has a pair of pinchers which are manipulated by a trigger such that two players using the two supporters can pick up string objects and place them in corresponding holding areas. The object of the game is to remove as many string objects as possible from a central holding area, and also from an opponents holding area, and deposit them in the player's own holding area.

7 Claims, 2 Drawing Sheets

STRING PICKUP GAME

BACKGROUND OF THE INVENTION

1. Field of the Invention

The present invention relates generally to amusement devices and, more specifically, to games which involves structure for picking up objects.

2. Description of the Related Art

Games for picking up balls have been known for some time. An example is disclosed in Japanese Utility Model Application No. 62-157981, wherein a game device is provided with rotatable arms respectively made of cylindrical members connected with one another and movable members mounted at the distal end of the rotatable arms. The movable members are used to pickup balls.

While the aforementioned game has many advantageous features, the structure does not provide for the taking back of balls possessed by the opponent and thus, the game is somewhat narrow in its purpose.

SUMMARY OF THE INVENTION

An object of the present invention is to provide a string pickup game which has as its purpose not only the gathering of objects but also the repossessing of objects previously gathered by an opponent.

Another object of the invention is to provide a string pickup game which is relatively simple in construction and cost effective to produce.

Another object of the present invention is to provide a string pickup game which tests the manual dexterity of two players.

In a preferred embodiment, a string pickup game apparatus includes a base having an upper surface and a lower surface, a central holding area formed centrally on the upper surface of the base and having an open top, two opposite side holding areas formed on the upper surface of the base on opposite sides of the central holding area, each having an open top, first and second supporters, each being rotatably connected to and extending upwardly from the base at positions respectively on opposite sides of the two opposite side holding areas, and each having a tapered opening which is smaller at a forward portion of the supporter and larger at a rearward portion of the supporter, first and second actuators slidably received in the tapered openings of the first and second supporters, respectively, each actuator having a forward end and a rearward end, and a connecting rod extending therethrough, a handle mounted on the rearward end of each actuator and including a trigger for manipulating the connecting rod, and a gripper mounted on the forward end of each actuator and including a pair of pinchers operatively connected to the connecting rod for picking up string objects in the central holding area and in the side holding area farthest from the corresponding supporter and depositing the string objects in the side holding area adjacent the corresponding supporter.

These objects, together with other objects and advantages which will be subseuqently apparent reside in the details of construction and operation of the apparatus as more fully hereinafter described and claimed, reference being had to the accompanying drawings forming a part hereof, wherein like reference numerals refer to like parts throughout.

DETAILED DESCRIPTION OF THE PREFERRED EMBODIMENTS

Figure 1:
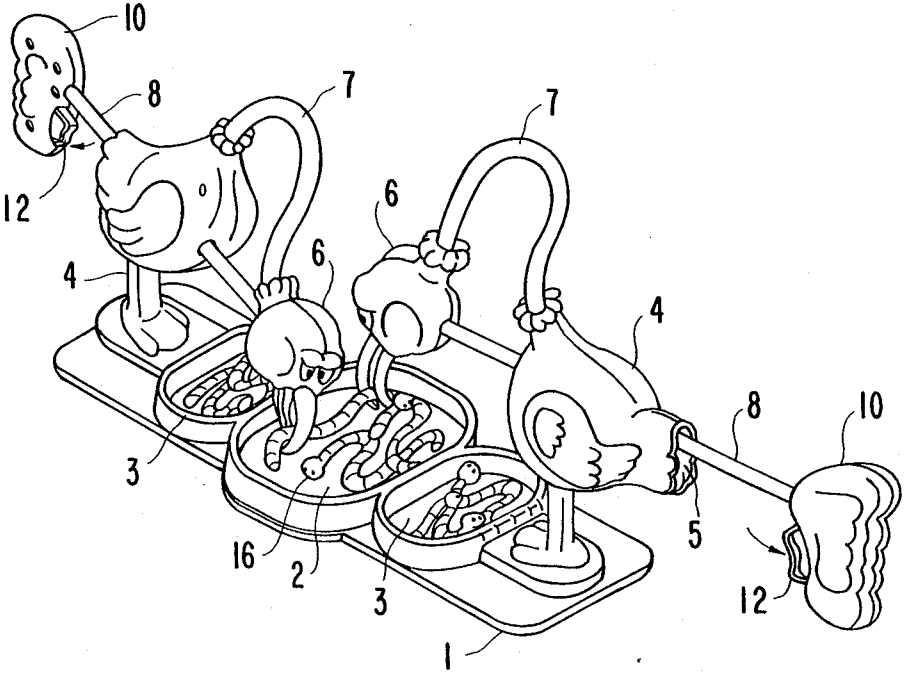
FIG. 1 is a perspective view of the string pickup game according to a preferred embodiment of the present invention.
Figure 2:
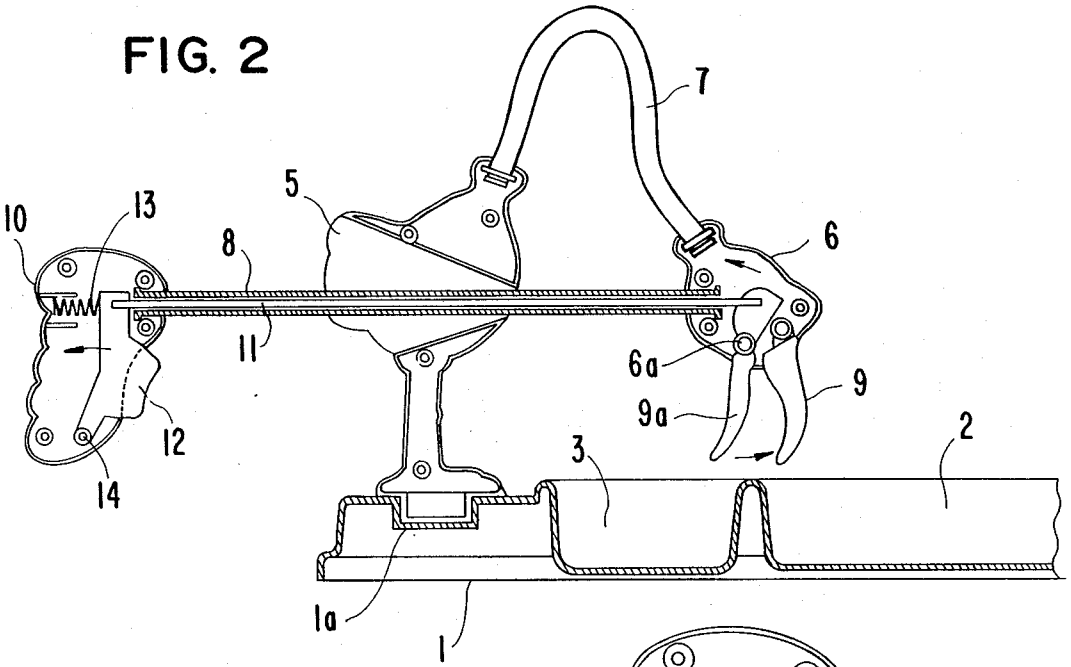
FIG. 2 is a side elevational view, partly in section, of a portion of the string pickup game illustrated in FIG. 1.
Figure 3:
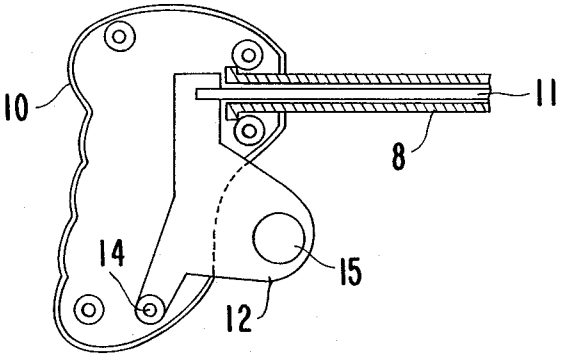
FIG. 3 is a side elevational view, partly in section, of a handle portion of the string pickup game according to FIG. 1.

Referring to FIGS. 1–3, a string pickup game includes a base 1 which is generally rectangular and has a flat lower surface for supporting the game on a table top or other suitable structure. The upper surface of the base 1 is provided with a central holding area 2 formed by a curved holding wall 2a, and two opposite side holding areas 3 disposed on opposite sides of the central holding area and formed by holding walls **3*a* and 3*b*. The opposite side holding areas are smaller than the central holding area 2. Each of the smaller opposite side holding areas 3 has a portion of its wall 3*a* or 3*b* integrally formed with adjacent wall portions of the wall 2*a* of the central holding area 2. The various holding areas may be integrally formed as a molded plastic unit with the base 1**, or the base and the holding areas may be separately formed and interconnected by conventional means, such as adhesive bonding. Each holding area has an open top for receiving objects (to be described later).

A pair of supporters 4 are constructed to resemble birds. Each supporter 4 has a leg portion 4a rotatably supported on a stand **4*b* adjacent to the two opposite side holding areas 3. Since the apparatus is preferably made of molded plastic materials, the rotatable connection need not include sophisticated bearings. FIG. 2 illustrates one type of rotatable connection, in which the leg portion 4*a* has a boss 4*c* fitted into a recess 1*a* of the base 1**.

Each supporter 4 is provided with an axial opening 5 which has a converging shape as illustrated in FIG. 2 wherein the forward portion **5*a* is relatively small and the rearward portion 5*b* is relatively large. As shown in FIG. 1, the forward portion 5*a* is substantially circular, while the rearward portion 5*b* is substantially elongated in the vertical direction. Thus, the opening is substantially tapered such that the opening is smaller at a forward portion of the supporter 4** and larger at a rearward portion of the supporter.

Each supporter 4 is provided with an actuator 8 which consists of a straight, cylindrical pipe having a forward end and a rearward end. Because of the tapered shape of the openings 5, the actuators 8 are capable of moving horizontally in and out and also vertically up and down at the ends, such that when the rearward end is raised, the forward end is lowered, and visa versa. The rearward ends of the actuators 8 are provided with handles 10, each of which mounts a trigger or operation knob 12. The operation knobs 12 are pivotally connected to the interior of the handles 10 as shown in FIGS. 2 and 3 by means of a pivot pin 14. The knob 12 is normally biased into an outward disposition by a spring 13. The spring 13 thus serves as a return for the knob 12 after it is pulled inwardly by a player.

As an alternative embodiment, instead of providing a spring 13, the operation knob 12 may be provided with a through hole 15 as ilustrated in FIG. 3 so that the player can push and pull the operation knob as desired by moving a finger in the through hole.

In either embodiment, the operation knob 12 operates a connecting rod 11 which extends through the actuator 8 to a gripper 6 mounted on the forward end of the actuator 8. Each gripper 6 includes a pair of pinchers 9 and 9*a*, of which pincher 9*a* is pivotally mounted in the gripper 6 by a pivot pin 6*a*. By pulling the trigger or operation knob 12 inwardly, the connecting rod 11 slides inwardly and thus causes the linked pincher 9*a* to move counterclockwise, thus closing the gap between the two pinchers. This creates a pinching action which enables a player to pick up the string objects originally deposited in the central holding area 2.

Preferably, the string objects 16 are shaped to resemble worms and are made of expandable and elastic synthetic resin. A mixture of long and short string objects are provided such that higher points may be awarded for the player who picks up the longer string objects and successfully deposits them in the side holding area 3 adjacent the players corresponding supporter 4.

A flexible pipe 7 is provided between the gripper 6 (which is designed to resemble the head of a bird) and a body portion in which the hole 5 is provided. Thus, it can be seem from the drawings that the supporter is designed to resemble a bird, the head of which can be moved horizontally by sliding the actuator 8 inwardly and outwardly. Moreover, the head can be moved vertically by pushing the handle 10 up or down. Pushing the handle upwardly would cause the head or gripper 6 to move downwardly. The actuator 8 is intended to be long enough such that a player may grip string objects previously deposited by a competing player's supporter in the competing player's side holding area 3. Thus, the gripper 6 can reach over the central holding area and into the side holding area 3 adjacent his or his opponent's supporter.

According to the present invention, by operating the handle in the longitudinal direction of the supporter, the gripper is moved as if a bird shrinks or expands its neck. By operating the handle in the vertical direction, the gripper is also moved as if a bird moves the neck vertically. By operating the operation knob or trigger, it is possible to pickup the string-like worms by opening or closing "the beak". This game thus offers an apparatus which allows the players to mimick the action of birds taking worms and thus provides a new and different type of game.

The many features and advantages of the present invention are apparent from the detailed specification, and thus, it is intended by the appended claims to cover all such features and advantages of the string pickup game apparatus which fall within the true spirit and scope of the invention. Further, since numerous modifications and changes will readily occur to those skilled in the art based upon the disclosure herein, it is not desired to limit the invention to the exact construction and operation illustrated and described. Accordingly, all suitable modifications and equivalents may be resorted to, falling within the scope and the spirit of the invention.

What is claimed:

1. A string pickup game apparatus for picking up a plurality of string-like objects, comprising:

a base having an upper surface and a lower surface;

a central holding area formed centrally on the upper surface of the base and having an open top;

two opposite side holding areas formed on the upper surface of the base on opposite sides of the central holding area, each having an open top;

first and second supporters, each being rotatably connected to and extending upwardly from the base at positions respectively on opposite sides of the two opposite side holding means, and each having a tapered opening which is smaller at a forward portion of the supporter and larger at a rearward portion of the supporter;

first and second actuators slidably received in the tapered openings of the first and second supporters, respectively, each actuator having a forward end and a rearward end, and a connecting rod extending therethrough;

a handle mounted on the rearward end of each actuator and including a trigger for manipulating the connecting rod; and a gripper mounted on the forward end of each actuator and including a pair of pinchers operatively connected to the connecting rod for picking up string objects in the central holding area and in the side holding area farthest from the corresponding supporter and depositing the string objects in the side holding area adjacent the corresponding supporter.

2. A string pickup game apparatus according to claim 1, wherein the string objects are of mixed length and are made of elastic material.

3. A string pickup game apparatus according to claim 1, wherein one of the two pinchers for each supporter is pivotally connected within the gripper, and wherein the connecting rod of each actuator is connected to the pivotally connected gripper so that manipulation of the connecting rod causes pinching movement of the pivotally connected pincher.

4. A string pickup game apparatus according to claim 1, wherein each handle includes a spring for biasing the trigger outwardly so that the connecting rod normally positions the pinchers in an open disposition.

5. A string pickup game apparatus for picking up a plurality of string-like objects, comprising:

a central holding area for holding the plurality of string objects;

first and second pincher means movable horizontally and vertically over the central holding area from opposite sides thereof;

means associated with each pincher means for moving each pincher means vertically and horizontally over the central holding area;

hand-held manipulator means associated with said pincher means for causing each pincher means to pinch string objects; and first and second side holding areas corresponding respectively to the first and second pincher means for receiving string objects picked up and deposited by each pincher means.

6. A string pickup game apparatus according to claim 5, wherein each pincher means comprises a pair of pinchers mounted in a gripper.

7. A string pickup game apparatus according to claim 6, wherein the hand-held manipulator means comprises first and second connecting rods connected respectively to the first and second pincher means, each being actuated by a trigger mounted on the pincher moving means.

* * * * *

UNITED STATES PATENT AND TRADEMARK OFFICE

CERTIFICATE OF CORRECTION

PATENT NO. : 4,863,164

DATED : Sept. 5, 1989

INVENTOR(S) : Mizunuma

It is certified that error appears in the above-identified patent and that said Letters Patent is hereby corrected as shown below:

Col. 3, line 38, change "his" (second occurrence) to --hers--.

Signed and Sealed this

Fifteenth Day of January, 1991

*Attest:*

HARRY F. MANBECK, JR.

*Attesting Officer*

*Commissioner of Patents and Trademarks*